US006010021A

United States Patent [19]

Zuidam et al.

[11] Patent Number: 6,010,021

[45] Date of Patent: Jan. 4, 2000

[54] ASSEMBLY CONSISTING OF A SERIES OF MINI-CONTAINERS

[76] Inventors: Laurens Aart Pieter Zuidam, Emmalaan 51, NL-3881 MS Putten; Rudy Hendrik Gerard Koster, Geerinkhof 672, NL-1103 RN, Amsterdam, both of Netherlands

[21] Appl. No.: 08/809,587

[22] PCT Filed: Sep. 25, 1995

[86] PCT No.: PCT/NL95/00320

§ 371 Date: Apr. 25, 1997

§ 102(e) Date: Apr. 25, 1997

[87] PCT Pub. No.: WO96/09232

PCT Pub. Date: Mar. 28, 1996

[30] Foreign Application Priority Data

Sep. 23, 1994 [NL] Netherlands ..... 9401551

[51] Int. Cl.[7] ..... B65D 21/024

[52] U.S. Cl. ..... 220/1.5; 220/23.8; 220/23.86; 206/514; 206/499

[58] Field of Search ..... 220/1.5, 23.83, 220/23.86, 23.4, 23.8, 23.6; 206/499, 514

[56] References Cited

U.S. PATENT DOCUMENTS

| | | | |
|---|---|---|---|
| 922,293 | 5/1909 | Kirchner | 220/1.5 |
| 2,530,444 | 11/1950 | Woods | 206/499 |
| 2,548,985 | 4/1951 | Lighter | 206/499 |
| 3,399,762 | 9/1968 | Potter | 206/499 |
| 3,499,694 | 3/1970 | Coppel | 220/1.5 |
| 3,749,273 | 7/1973 | Wreghitt et al. | 220/1.5 |
| 3,921,840 | 11/1975 | Julien, Sr. et al. . | |
| 3,966,075 | 6/1976 | Schultz | 220/1.5 |
| 4,008,916 | 2/1977 | Ide | 206/499 |
| 4,819,820 | 4/1989 | Weiner | 220/1.5 |
| 5,265,748 | 11/1993 | Furukawa | 220/1.5 |
| 5,584,527 | 12/1996 | Sitter | 220/1.5 |

FOREIGN PATENT DOCUMENTS

| | | | |
|---|---|---|---|
| 0 541 832 | 5/1993 | European Pat. Off. . | |
| 596 755 | 5/1994 | European Pat. Off. . | |
| 39 08 103 | 9/1990 | Germany . | |
| 0 554798 | 10/1974 | Switzerland . | |
| 1 390 518 | 4/1975 | United Kingdom | 220/1.5 |

*Primary Examiner*—Stephen Castellano
*Attorney, Agent, or Firm*—Young & Thompson

[57] ABSTRACT

Assembly consisting of a series of mini-containers and a standard ISO container. The sizing of the mini-containers is such that these can be accommodated inside the housing of the ISO container. In this assembly two mini-containers which may be stacked on top of one another are accommodated in the ISO container, where the length of the mini-container is equal to the internal width of the ISO container.

6 Claims, 2 Drawing Sheets

ASSEMBLY CONSISTING OF A SERIES OF MINI-CONTAINERS

BACKGROUND OF THE INVENTION

The present invention relates to an assembly comprising a number of mini-containers which can be coupled to one another as well as to a part which has the base dimensions of an ISO container.

DESCRIPTION OF THE RELATED ART

An assembly of this type is disclosed in European Patent Application 0 596 755. This publication describes mini-containers which have a length equal to the external transverse dimension of a standard ISO container. A number of mini-containers of this type can be placed transversely on a standard ISO loading platform and coupled to one another. In this way, mini-containers can be assembled to give a container block, which can be handled using conventional handling equipment for ISO containers. Mini-containers of this type can be removed from the loading platform at the place of destination.

Although a container system of this type is particularly attractive for, for example, use in large towns where customers are difficult to reach, there is the problem that the mini-containers are arranged relatively unprotected on the loading platform and, moreover, that, in any event, the end containers of a series of mini-containers must comply with the requirements laid down by ISO. Because it cannot always be guaranteed that specific mini-containers will be located at the ends of a loading platform, this implies in practice that, in particular, all corner points of all mini-containers must comply with the ISO requirements.

This implies that these mini-containers must be of relatively heavy construction, which raises the cost price.

Moreover, in European Patent Application 0 596 755 it is proposed to provide the short side of the mini-containers with doors. When assembled to produce a series of containers, this means that a large number of doors are exposed to interference by unauthorised persons.

In order to prevent adverse consequences, it is necessary to make the hinges and locking Systems of such doors of relatively heavy construction, as a result of which the costs of such mini-containers are yet further increased.

Finally, the loading platform used, on which the mini-containers are arranged, can be used only in combination with mini-containers of this type. There is no other conceivable use.

SUMMARY OF THE INVENTION

The aim of the present invention is to provide a construction with which the mini-containers are afforded greater protection and can be of more lightweight construction and with which the construction which accommodates the mini-containers is not only suitable for use in combination with mini-containers.

This aim is achieved in the case of an assembly as described above in that said part comprises a complete ISO container and in that the mini-containers are dimensioned so as to be accommodated in the interior of said ISO container.

Despite the fact that the carrying capacity of the mini-containers according to the invention is somewhat lower than the loading volume according to European Patent Application 0 596 755 as a result of the presence of the wall of the ISO container, the use of the mini-containers according to the invention is advantageous. After all, mini-containers of this type can be of relatively lightweight construction. This has an effect not only on the purchase price for such mini-containers but also on the carrying capacity of the ISO containers in which such mini-containers are arranged. Because the mini-containers are enclosed within a larger ISO container, the specifications in respect of hinges and locking systems do not have to be too stringent. Moreover, the ISO container in which the mini-containers are accommodated can also be used for other purposes.

A particularly effective use of space is obtained if two mini-containers stacked one on top of the other are accommodated in a standard ISO container.

The width of each mini-container is preferably equal to the internal width of a standard ISO container. Optimum filling of a standard ISO container can be provided in this way.

In contrast to the construction described in European Patent Application 0 596 755, it is proposed to arrange the loading doors in the largest face of the mini-container. Optimum accessibility is ensured by this means. Likewise, stacking the mini-containers one behind the other automatically shuts off the doors concerned.

Although the standard ISO container can be any ISO container disclosed in the prior art, it is preferably a 20 ft container.

Such containers can easily be transported by road and by water.

In this context, the construction of the mini-containers is preferably such that ten such mini-containers can be arranged in such a standard ISO container. If the mini-containers are stacked on top of one another, this implies five mini-containers per length of standard ISO container. Mini-containers 230 cm, 125 cm wide and 125 cm high can then be accommodated in the 20 ft container described above.

It will be clear that the mini-containers described above can be handled in any manner disclosed in the prior art for ISO containers. For instance, they can be arranged on lorries, handled by cranes and, for example, provided with lifting leg means for storage of said mini-containers independently of other constructions.

The invention also relates to a mini-container to be used with the abovementioned assembly.

BRIEF DESCRIPTION OF THE DRAWINGS

The invention will be explained in more detail below with reference to an illustrative embodiment shown in the drawing.

In the drawing.

SUMMARY OF THE INVENTION

Figure 1:
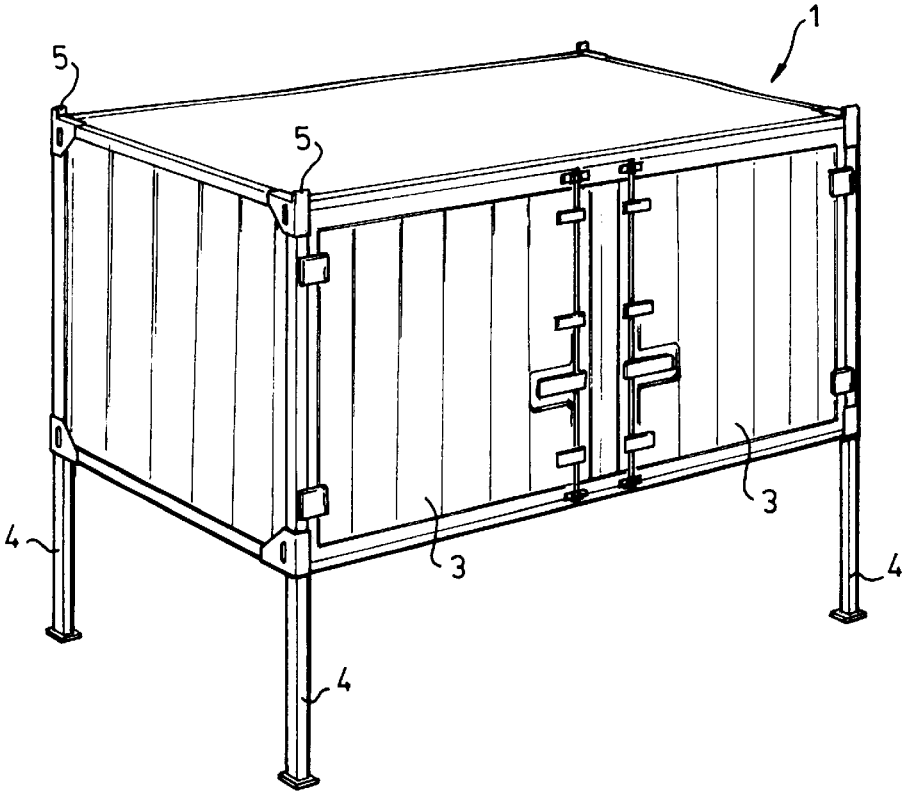
FIG. 1 shows a perspective view of a preferred embodiment of a mini-container according to the invention.

In FIG. 1, the mini-container according to the invention is indicated in its entirety by 1. This mini-container comprises a number of peripheral walls which delimit a housing for accommodating a load therein.

At least one of the peripheral walls is provided with doors 3. The corner points of the mini-container are provided with couplings, which are not defined in more detail, in order to couple these both to a chassis and to other (mini)-containers.

In the embodiment according to FIG. 1, legs 4 are provided. These legs are unfoldable/extendable in any way, as a result of which the mini-container according to the invention can be placed independently in any location.

Figure 2:
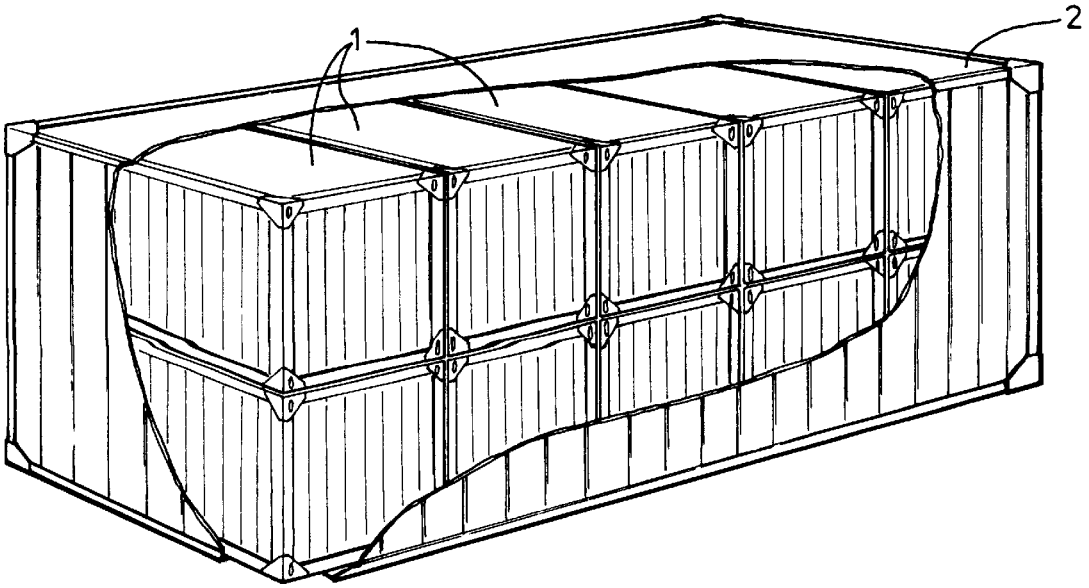
FIG. 2 shows a perspective and partially exposed view of a number of mini-containers according to the invention accommodated in a standard ISO container.

FIG. 2 shows a standard ISO container 2. The mini-containers 1 shown in FIG. 1 are dimensioned in such a way that said mini-containers can be accommodated transversely in an ISO container of this type. In this context, two such containers are preferably stacked on top of one another. The mini-containers can optionally be coupled to one another or to the floor of the standard ISO container.

Figure 3:
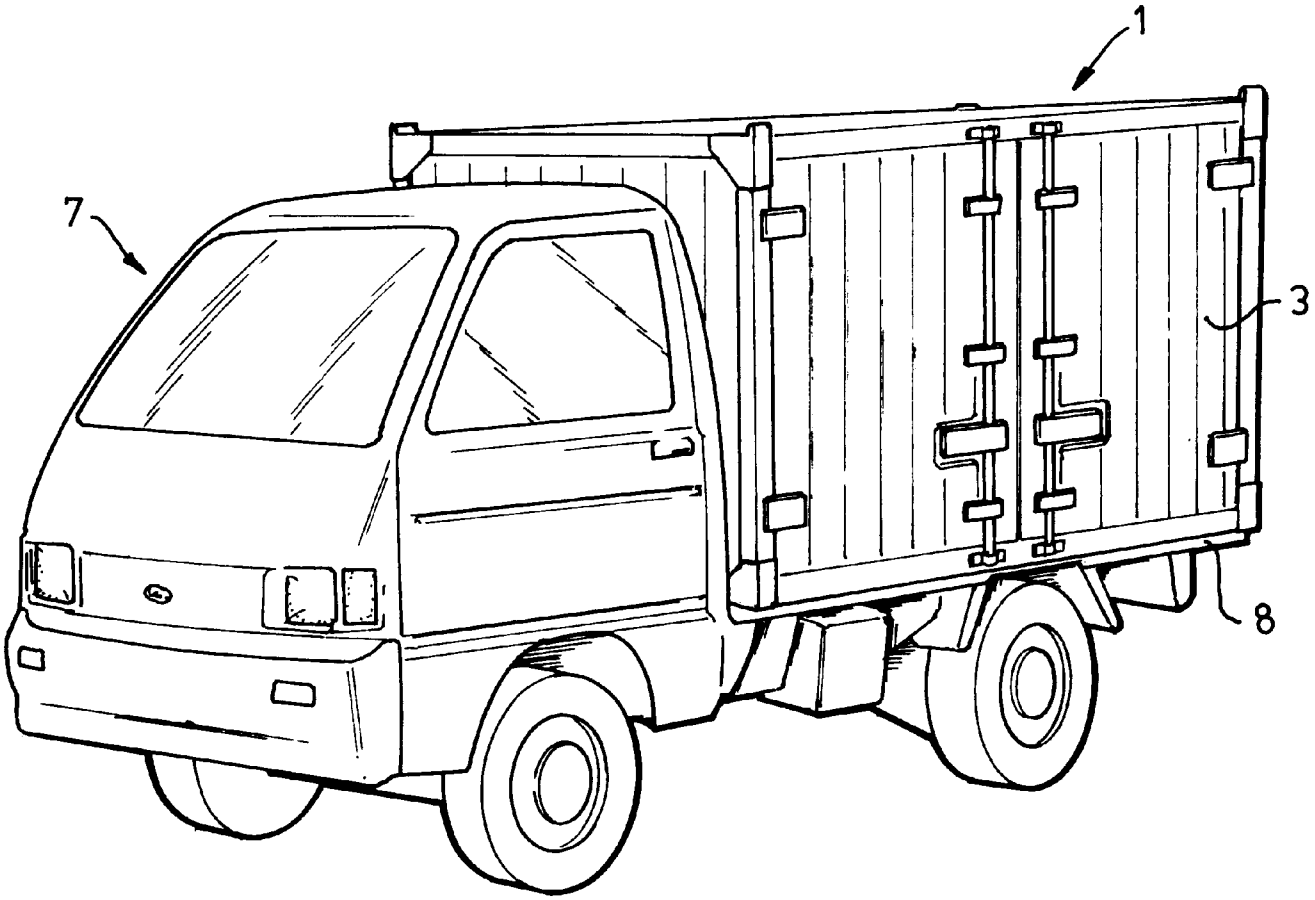
FIG. 3 shows the use of a mini-container on a lorry.

FIG. 3 shows a lorry 7 provided with a loading platform 8. A mini-container 1 according to the invention is arranged on this loading platform 8.

Although the intention has been described above with reference to a preferred embodiment, it must be understood that numerous modifications can be made thereto without going beyond the scope of the present application.

For instance, FIG. 2 shows how five mini-containers in the transverse direction correspond to the length of one standard ISO container. This number can, of course, be larger or smaller and it is also possible to design the mini-containers in the longitudinal direction such that the mini-containers fit in the longitudinal direction in a standard container. It is also possible to provide other sides of the mini-containers with doors.

Moreover, mini-containers of different dimensions can be accommodated inside an ISO container. In this context it is, for example, possible for certain mini-containers to be half the size of other mini-containers.

These and other variants are considered to fall within the scope of the present claims.

We claim:

1. An assembly comprising:

at least two rectangular mini-containers and a first container comprising a load face, said mini-containers comprising corner point couplings adapted to be couplable to each other and to said load face, said load face having the base dimensions of the first container, said mini-containers having length substantially corresponding to the width of said load face, said first container having walls and a flat roof, wherein the length of said mini-containers substantially corresponds with the interior width of said first container and having a height being approximately half the internal height of said first container, wherein each of said mini-containers comprises a door within a mini-container face, and wherein at least one of said mini-containers is coupled with said couplings to said load face and said two mini-containers are coupled to one another with others of said couplings.

2. Assembly according to claim 1, wherein each mini-container is provided with only a single door set located in a longitudinal face thereof.

3. Assembly according to claim 1, wherein said couplings are further adapted for connecting to a loading platform.

4. Assembly according to claim 1, wherein each mini-container is provided with coupling means at its roof.

5. Assembly according to claim 1, wherein the mini-containers are dimensioned such that ten mini-containers can be accommodated within said first container.

6. Assembly according to claim 1, wherein each mini-container comprises a leg means.

* * * * *